US006073674A

United States Patent [19]

Hörmann

[11] Patent Number: 6,073,674

[45] Date of Patent: Jun. 13, 2000

[54] SECTIONAL OVERHEAD DOOR

[75] Inventor: Thomas J. Hörmann, St. Wendel, Germany

[73] Assignee: Hörmann KG Brockhagen, Steinhagan, Germany

[21] Appl. No.: 09/091,681

[22] PCT Filed: Dec. 23, 1996

[86] PCT No.: PCT/DE96/02509

§ 371 Date: Jul. 17, 1998

§ 102(e) Date: Jul. 17, 1998

[87] PCT Pub. No.: WO97/23700

PCT Pub. Date: Jul. 3, 1997

[30] Foreign Application Priority Data

| | | | |
|---|---|---|---|
| Dec. 22, 1995 | [DE] | Germany | 295 20 467 U |
| Mar. 29, 1996 | [DE] | Germany | 296 05 912 U |
| Sep. 13, 1996 | [DE] | Germany | 296 15 973 U |

[51] Int. Cl.[7] ..... E05D 15/06

[52] U.S. Cl. ..... 160/201; 160/191

[58] Field of Search ..... 160/201, 191, 160/192, 316; 267/290

[56] References Cited

U.S. PATENT DOCUMENTS

| | | | |
|---|---|---|---|
| 2,036,802 | 4/1936 | Fleishman et al. | 160/192 |
| 2,069,665 | 2/1937 | Bouthillier . | |
| 2,538,626 | 1/1951 | Olsen . | |
| 2,543,711 | 2/1951 | Schultz | 160/316 |
| 2,702,082 | 2/1955 | Wolf | 160/191 |
| 2,818,311 | 12/1957 | Ashley, Jr. | 267/290 |
| 2,934,336 | 4/1960 | Kimsey et al. | 267/290 |
| 5,275,223 | 1/1994 | Magro et al. | 160/191 |

*Primary Examiner*—Blair M. Johnson
*Attorney, Agent, or Firm*—Max Fogiel

[57] ABSTRACT

A sectioial overhead door is disclosed with a door leaf comprising several consecutive hinging panels (10, 10', 10") which are guided in the known way by rollers (11) in horizontal tracks and in tracks (12, 12', 12") joined to them to form a bow and are provided with a balancing device (15) in the form of approximately horizontal helical tension springs. The latter are designed to be space-saving, in particular with low drop heights, underneath the horizontal track sections extending into the building, such that on each of the outer side regions (27) of the horizontal track sections (12, 14) facing away from one another one or more helical tension spring units (16) are arranged approximately parallel to one another and one below the other. At least some of the helical tension spring units (16) consist of at least two coaxial helical springs (17, 18), the turns of which are mutually opposing and intersecting.

3 Claims, 9 Drawing Sheets

SECTIONAL OVERHEAD DOOR

BACKGROUND OF THE INVENTION

The present invention concerns an articulated overhead door comprising several panels linked together one after another in the direction of motion. The panels are guided by rollers at each end traveling in two sets of lateral tracks. The first set of tracks has a more or less vertical section that merges into a curved section and then into a horizontal section. The second set of tracks has a horizontal section that merges into a downward-sloping section and then, next to the doorway, into a vertical section. The horizontal section is positioned just over and paralleling the horizontal section of the first set of tracks. All the panels except the one that is uppermost when the door is closed are guided by rollers that travel in the first set of tracks. The panel that is uppermost when the door is closed is guided by rollers at the upper edge. These rollers travel in the second set of tracks. The door is balanced by a mechanism comprising more or less horizontal helical tension springs, deflection rollers, and cables. One end of each spring is secured to a part of the building extending away from the doorway. The other end of each spring, the end extending into the doorway, is fastened to a deflection roller. Each cable is fixed at one end, wraps around a deflection roller, and extends to a point established at one end of the bottom edge of the panel that is lowermost when the door is closed.

Articulated overhead doors are often preferred to unarticulated overhead doors because they require less space inside the building to open and close. They occupy less space above the doorway's lintel than a roll-up door does. They are also easier to handle than vertically or horizontally swinging doors, which require space both inside and sometimes outside the building.

Attempts have been made to get along with less space above the lintel by employing what are called subsidiary tracks for the rollers that guide the panel that is uppermost when the door is closed. Such tracks either extend over the horizontal sections of the tracks that the other panels' rollers travel in or are integrated into them as far as the sections that face and slope down toward the doorway. A door-balancing shaft can be mounted above such sections, and, even though the downward slope helps to provide room for it, a lot of space is still needed above the upper edge of the doorway.

Mounting tension-spring mechanisms above (CH Patent 343 624) of below (U.S. Pat. No. 2,271,309) the horizontal section of the track instead of a torsion-spring shaft behind the lintel has been suggested. This approach, however, demands more overhead space, especially in a garage, or decreases the space at each side and below the horizontal sections of track.

SUMMARY OF THE INVENTION

The object of the present invention is accordingly an articulated overhead door of the aforesaid genus that will take up as little space as possible, especially above the lintel, and will leave space on each side of the horizontal sections that extend into the building.

This object is attained in accordance with the present invention in that the springs are combined into modules, each comprising either a single spring or a stack of two or more more or less parallel helical tension springs, on each outer side of the horizontal sections of track.

Mounting a spring module, and especially a stack of springs when more force is required, on the outer side of the track maintains the space above and below the horizontal sections clear of door-balancing mechanisms. The space between the top of the horizontal sections and the ceiling will accordingly be defined by the upper edge of the panel that is uppermost when the door is closed as the panel moves. The space below these sections will be left extensively clear. The spring mechanisms mounted on the outer sides will keep the lateral installation space relatively small.

Some or all of the spring mechanisms in one particularly preferred embodiment of the present invention can include a pair of coaxial helical springs. The outside coil diameter of the inner spring in such a mechanism can be shorter than the inside coil diameter of the outer spring. The coils of the inner spring can fit between those of the inner spring. This feature eliminates the need for spacers between the coils or for spring holders. The coils of one such spring can be right-handed and those of the other left-handed, in which case the coils of the outer spring will intersect those of the inner spring preventing those in one spring from engaging the gaps between two flights in the other spring. The springs can accordingly be positioned with their coils relatively close to one another. Of particular advantage is that such a spring can help to ensure safe operation by stopping free-flying fragments and wire ends if the other spring breaks, eliminating the need for such special safety devices as core cables, telescoping jackets, etc.

Another advantage of this approach, which reduces the space needed for tensioning mechanisms by positioning one or more helical springs one inside another or one engaging another is that it allows a particular spring characteristic, individual spring range, or total spring range to be established on each side by installing several weaker springs in a small space. Furthermore, a particular spring factor can be exploited to affect the overall characteristic, and separate springs of varying characteristic can be combined and paralleled.

Another way of adjusting the spring force on one side to the weight of the door is also provided to advantage in that the position of the ends of the spring mechanisms fixed to the building can be varied by for example suspending a spring holder in a series of holes stamped out of the horizontal section of the track. Another and possibly additional method of adjustment is to vary the height of the fixed holder that holds one end of the cable. This approach is preferably and simply embodied in the form of a series of openings that a holder, especially one that compensates for the different lengths of two parallel cords in order to compensate for the distribution of load, can be inserted into. This measure will not only allow the load on the springs to be adjusted but will also permit the individual cables to be cut to the same length during installation. Symptoms of aging can also be corrected.

The helical tension spring modules can basically have hooks at each end. The springs, however, will preferably be flat-ended and operate in conjunction with holders of the species disclosed in Europe Patent 0 288 061 B1.

The simple means of securing the weight-compensation mechanisms against damage from broken springs hereintofore described can be augmented with additional means of ensuring safety. The cables that connect the ends of the spring modules attached to the door to the lower edge of the lowermost panel can be double. The two parallel and equally tensioned strands wrap around correspondingly separate series of rollers at the curve in the track, where they rest on resilient supports. The cables in one particularly preferred embodiment can be maintained equally tensioned in that their common ends are held against a weight-compensation mechanism that will accommodate any differences in length between the two strands of the sort that especially occurs in operation, allowing each strand to support its own share. A simple weight-compensation mechanism of this type can be in the form of a rocker that pivots back and forth around a shaft with stops distributed on both sides and along the cable and accommodating the end of the cable on each side. Appropriate for this purpose is an attachment whereby the widened end of the cable engages a suspension as in a Bowden cable. The stops will preferably extend along with the ends secured by them upstream of the shaft. In this event, any difference in the lengths of the two strands will tilt the rocker such that the angle allowed by the difference will be more obtuse than when the stops are at the same level along the cable as the shaft or upstream of it.

BRIEF DESCRIPTION OF THE DRAWINGS

One embodiment of the present invention will now be specified by way of example, whence further advantageous characteristics can also be derived, with reference to the accompanying drawings, wherein.

DESCRIPTION OF THE PREFERRED EMBODIMENTS

Figure 1:
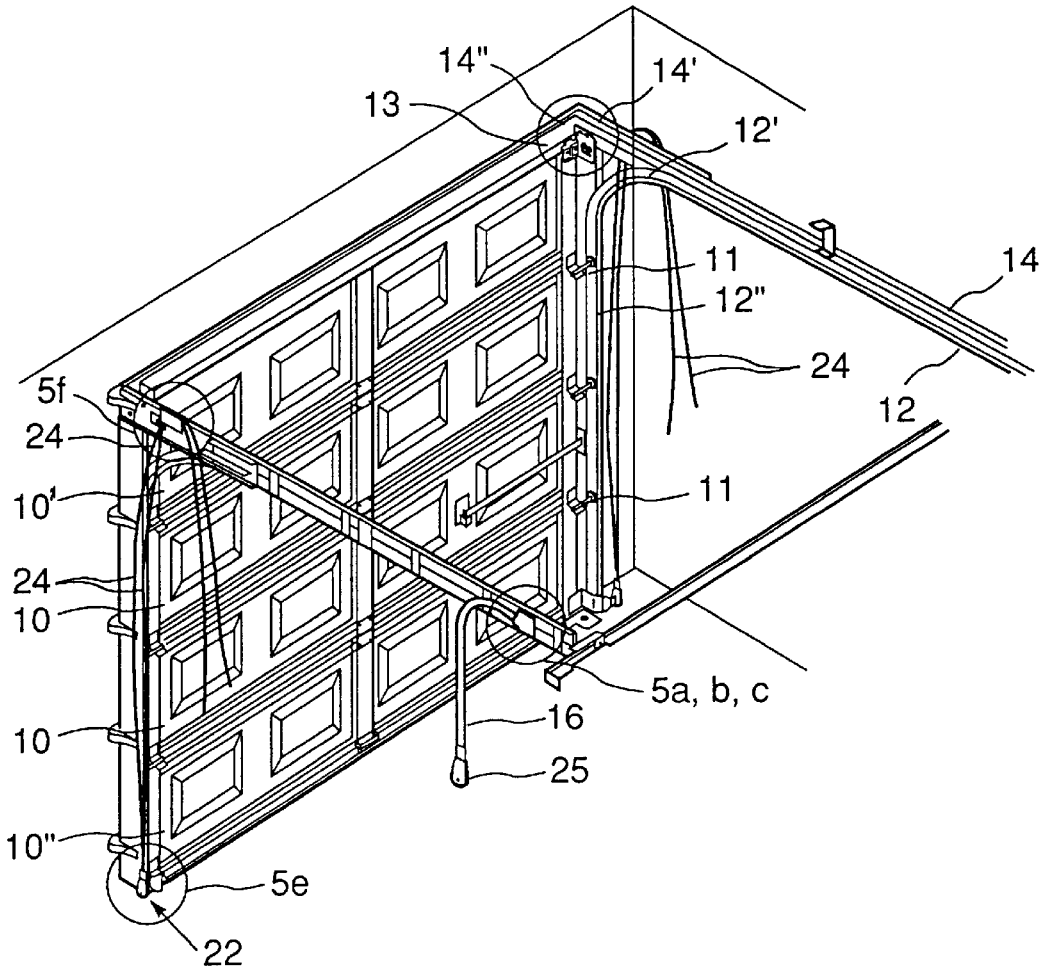
FIG. 1 is a perspective view of the inner surface of an articulated overhead door with its tracks and with a schematically represented weight-compensation mechanism, FIGS. 2*a* and 2*b* comprise a top view, respectively, and a side view, from the vicinity of the door itself, of the horizontal and bent down or curved sections of the track.

The articulated overhead door schematically illustrated in FIG. 1 comprises a series of panels 10. The panel 10' that is uppermost when the door is closed and the panel 10" that is lowermost when the door is closed differ from the other panels. All the panels except for panel 10' are guided by rollers 11 that travel in tracks at each edge of the door. Each track comprises a horizontal section 12, a curved section 12', and a vertical section. The rollers 11 that guide panel 10' are at its upper edge 13 and travel in a second set of tracks, each of which comprises a horizontal section 14 and a section 14' that slopes down toward the doorway, terminating in a bent-down section 14".

Such an embodiment, with two sets of tracks, is in itself known. The door is provided with a weight-compensation mechanism 15 comprising an also in-itself known system of helical tension spring modules and associated cables, whereby a helical tension spring module parallels each horizontal section of track. One end of the spring modules is secured to the building, and the end toward the door to a deflection roller. A cable wraps around the deflection roller. One end of the cable is secured at the lower edge of the lowermost panel and the other fixed, generally to the doorframe. The tension-spring mechanisms in accordance with the present invention, however, are mounted on each of the outward-facing sides of the horizontal sections 12 and 14 of the tracks such as to occupy practically no space above or below the tracks. Furthermore, the volume of space occupied by the helical tension spring mechanisms at each side is very small because all the helical tension spring modules 16 required to balance the door or accommodate the force and to keep the door up if a spring should break are paralleled and stacked. Furthermore, one spring in each pair is accommodated inside the other. The coils of each inner spring 17 are wound opposite the coils of its associated outer spring 18 such that, as viewed perpendicular to the axes of the springs, the coils intersect at an acute angle, as will be particular evident from FIGS. 3 and 4.

The tension-spring mechanisms associated with each horizontal section of track and comprising one or more paralleled helical tension spring modules 16 are as will be evident from FIG. 5 fixed to the building at the end of the horizontal sections 12 and 14 more remote from the doorway. The sections are joined together at the end near the doorway and provided with a deflection roller in the form of one or a pair 25 of rollers. Each roller is provided with two parallel grooves. A cable 21 is accommodated in each groove. Cables 21 extend parallel, with their ends practically against the same mechanisms, specifically on the one hand to a common point 22 established at one end of the bottom edge of the panel 10" that is lowermost when the door is closed, and on the other to the end of horizontal sections 12 and 14. Each cable extends around a direction-reversing roller 24 between each pair 25 of deflection rollers and point 22, allowing the position of that point to be adjusted the motion of the door with respect to the fixed axes of the spring mechanisms.

Figure 2A:
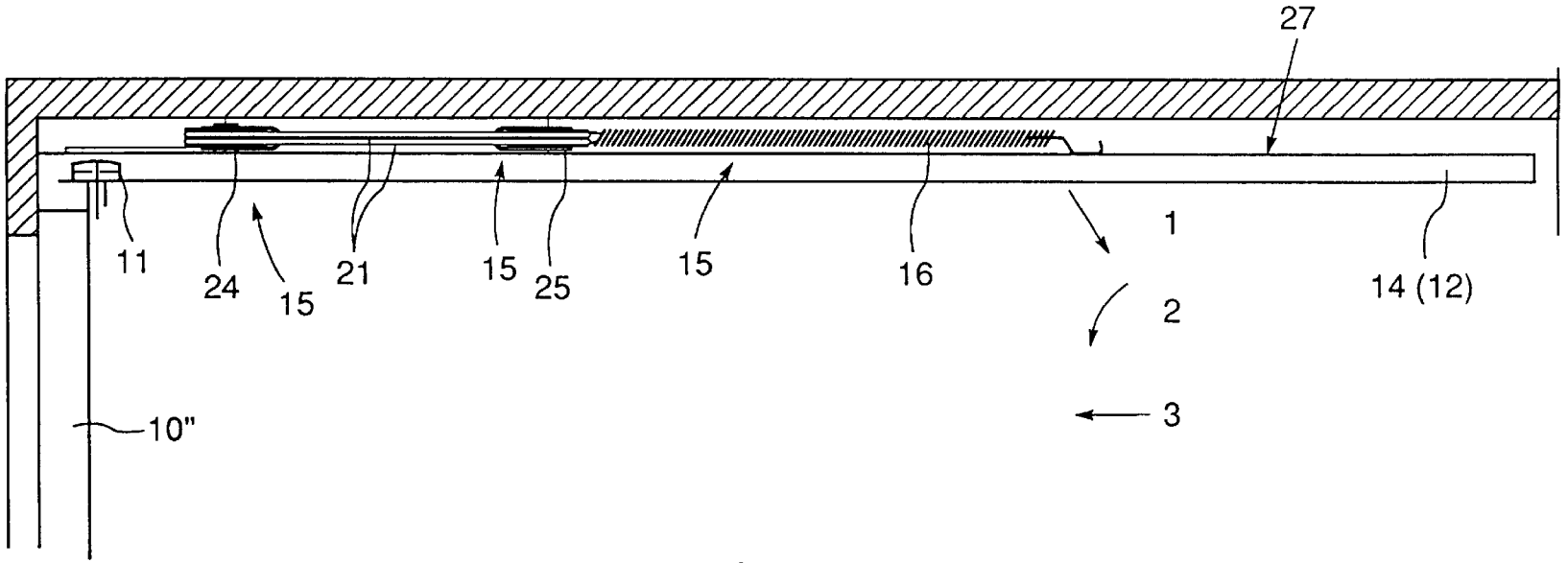
Figure 2B:
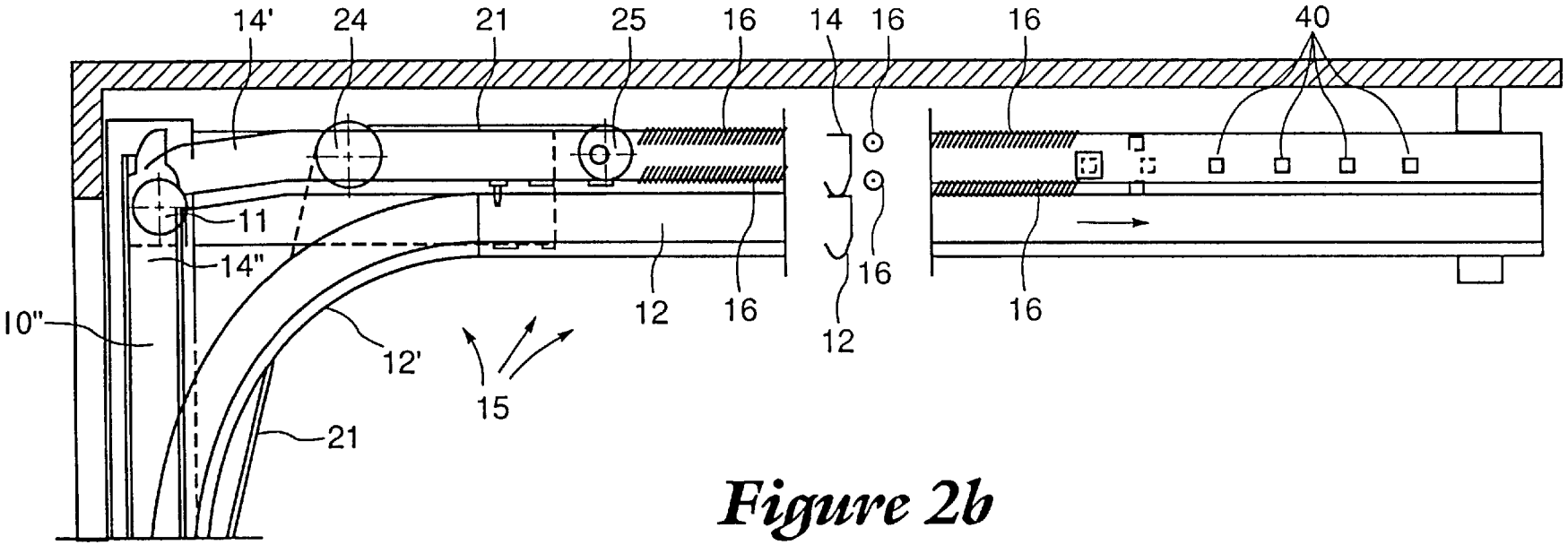
Figure 3A:
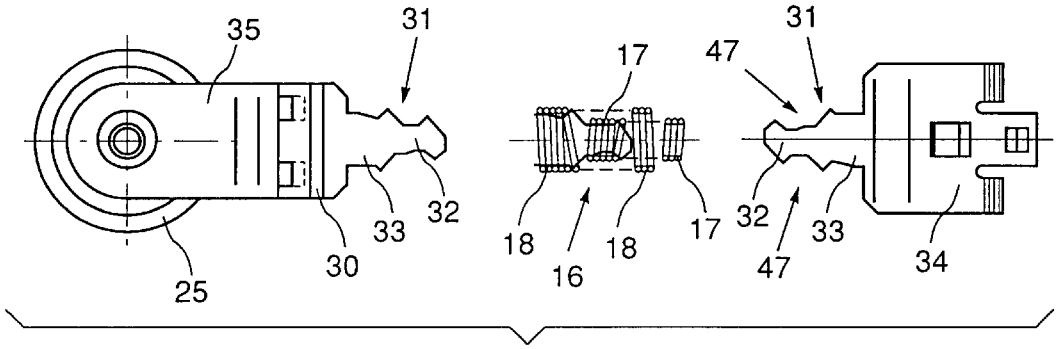
FIGS. 3*a*–3*e* are a series of details of various embodiments of one or more paralleled spring modules, each comprising two coaxial springs, along with a schematic section through one pair of springs.
Figure 3B:
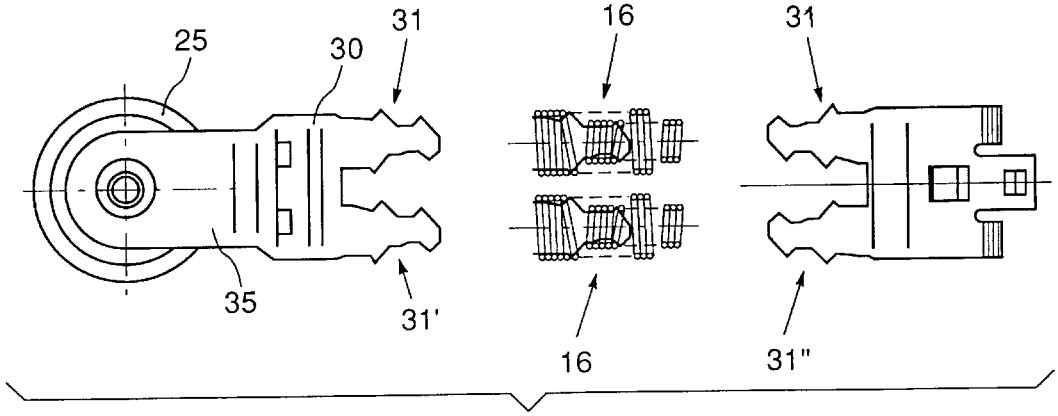
Figure 3C:
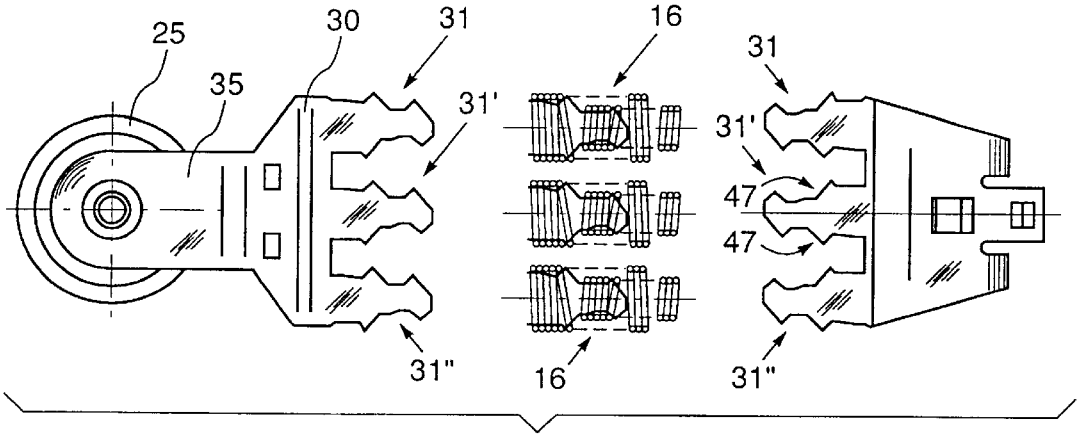
Figure 3D:
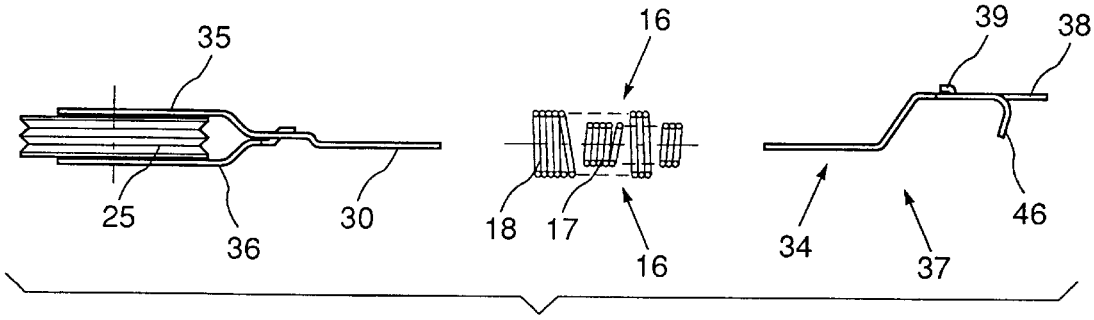
Figure 3E:
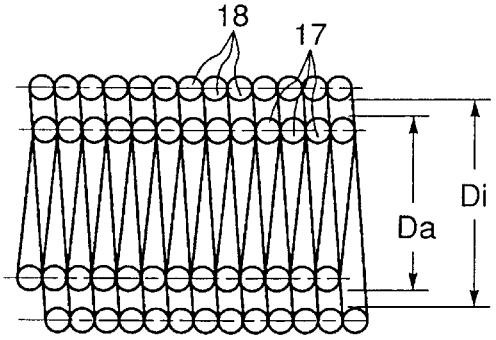

The two views in FIG. 2 illustrate how helical tension spring modules 16 are disposed in relation to horizontal sections 12 and 14. Each schematically illustrated spring mechanism comprises two coaxial helical springs with opposingly wound coils. Also illustrated are the two parallel cables associated with each spring mechanism. The side view in FIG. 2 is schematicized at the middle. The design and position of the horizontal sections 14 and 15 of track and of one helical tension spring mechanism comprising two stacked helical tension spring modules 16 will be evident. The space left in the illustration by breaking off the side view in the vicinity of the horizontal sections of track is occupied by a section perpendicular to the length of the tracks. Also evident from the side view in FIG. 2 is a series 40 of holes punched out of the end of horizontal section 14 toward the building. These holes are associated with a deflection-roller anchoring structure 37 secured to the end, inside the building, of a helical tension spring module 16 as will be specified later with reference to FIG. 5.

FIG. 3 is a sort of exploded view illustrating how three different embodiments of the tension-spring mechanism can be secured to the sides of horizontal sections 12 and 14. One embodiment comprises a single helical tension spring module 16, another embodiment two parallel modules, and a third three parallel modules. Each module comprises two coaxial springs 17 and 18, with their midsections illustrated abbreviated. At each end of each embodiment, with one, two, or three spring modules, is a connector 30 comprising roller holders 35 and 36, spring-securing structures 31, 31', and 31", one for each spring module 16, and deflection-roller anchoring structures 37 with flanges 38 and 39. There is a top view of each such structure below its corresponding side view. How the springs in each spring module are attached to the holders will be specified hereinafter with reference to FIG. 4.

At the bottom of FIG. 3 is a longitudinal section through a spring module comprising two coaxial springs, specifically an inner spring 17 and a outer spring 18. As will be evident from the figure, the coils 20 of one spring are wound opposite those of the other with respect to their common axis 29 and accordingly intersect at an acute angle. Since the outside diameter Da of inner spring 17 is shorter than the inside diameter Di of outer spring 18, the springs can move independently without any of the coils of one from entering the gaps between the coils of the other, even though the difference Di–Da between the two diameters is short. To decrease the friction between adjacent areas of coils 20, they can be provided with a low-friction protector, a sleeve shrunk into between the coils or a jacket of low-friction plastic for instance.

Figure 4A:
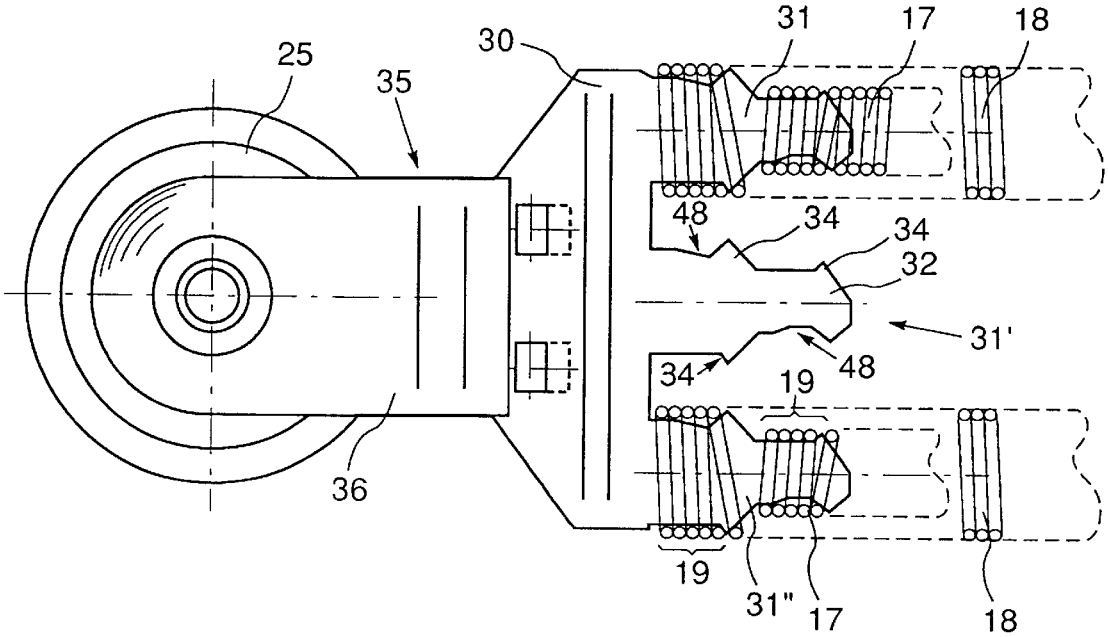
FIGS. 4*a* and 4*b* are larger-scale, partly sectional side and top view, respectively, of part of one of the embodiment illustrated in FIG. 3*b*, and FIGS. 5*a*–5*f* comprise larger-scale perspective views of various areas of FIG. 1.
Figure 4B:
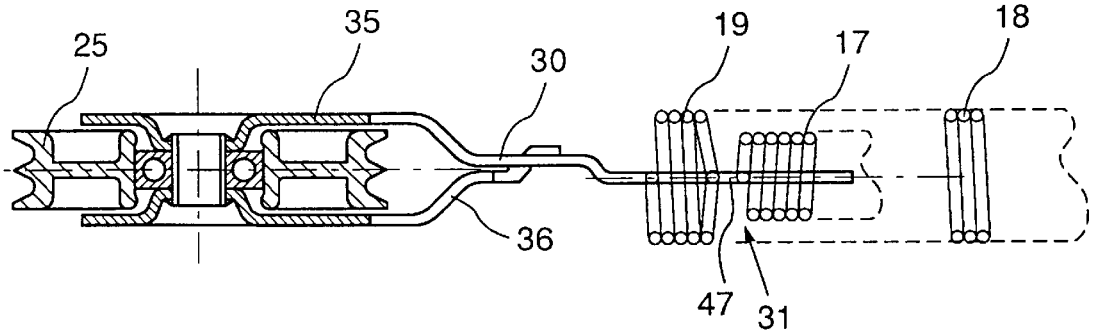

FIG. 4 illustrates, with one end of a helical tension spring mechanism with three helical tension spring modules 16 as a example, how the springs are attached to a common flat connector 30. Connector 30 is provided with three spring-securing structures 31, 31', and 31" extending toward the spring modules. The spring-securing structures are in the same plane and each has a narrower spring-securing section 32 and a wider spring-securing section 33 between it and the rest of connector 30. As will be evident from the top and side views in FIG. 4, the outer spring 18 in each module 16, the spring with the long inside diameter, has been thrust over wider spring-securing section 33 toward the rest of the connector such that some of its coils 19 engage the backs of barbed projections 34 on the edges 47 of the spring-securing section and can accordingly be thrust farther in but not out. Inner spring 17, the one with the short outside diameter, has been similarly thrust over the narrower spring-securing section 32 and secured. Since narrower spring-securing section 32 and its barbed projection 34 and an associated depression 48 are at an angle of 180° to wider securing section 33 and its projection and depression, it will be evident that the two springs are wound in opposite senses.

Mounted on the section of connector 30 more remote from spring-securing structures 31 is a roller holder 35 comprising cheeks extending out of connector 30 and a counterbearing 36 suspended, as will be evident from the top view, in the connector.

FIG. 5 is a series of larger-scale details of FIG. 1. FIG. 5*a* illustrates the variable-length building-end attachment of a helical tension spring mechanism comprising one or more parallel helical tension spring modules 16 but represented in this event by a single spring. A deflection-roller anchoring structure 37 of the species illustrated in FIG. 3 is secured to the end extending into the building. Deflection-roller anchoring structure 37 can be inserted into any desired hole in a series 40 by means of a flange 39 that extends foward. Once flange 39 has been inserted, spring module 16 engages it behind the wall of horizontal section 14. Another flange 38, which extends opposite flange 39, is provided with a bore. This bore comes into alignment with a punched-out hole next to one of punched-out holes that flange 39 extends through once flange 38 is engaged. A bolt is then inserted through this hole and through the bore in flange 38 as indicated in FIGS. 5*a*, 5*b*, and 5*c*. Deflection-roller anchoring structure 37 is maneuvered during this procedure by means of a suspension clip 46 integrated into it.

Figure 5B:
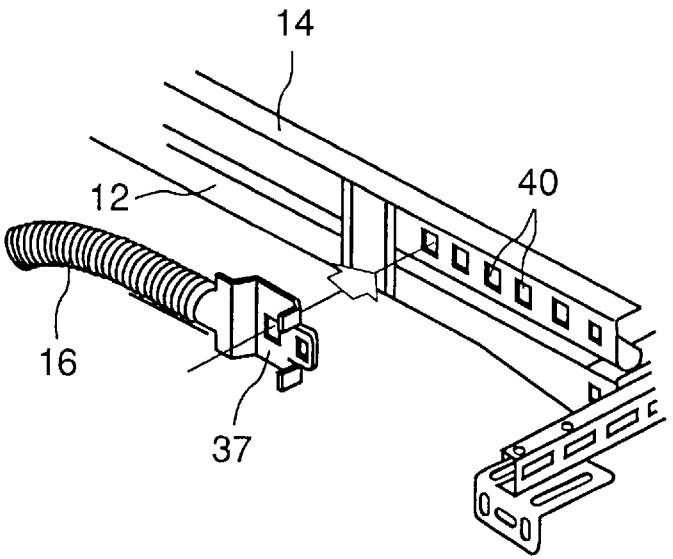
Figure 5A:
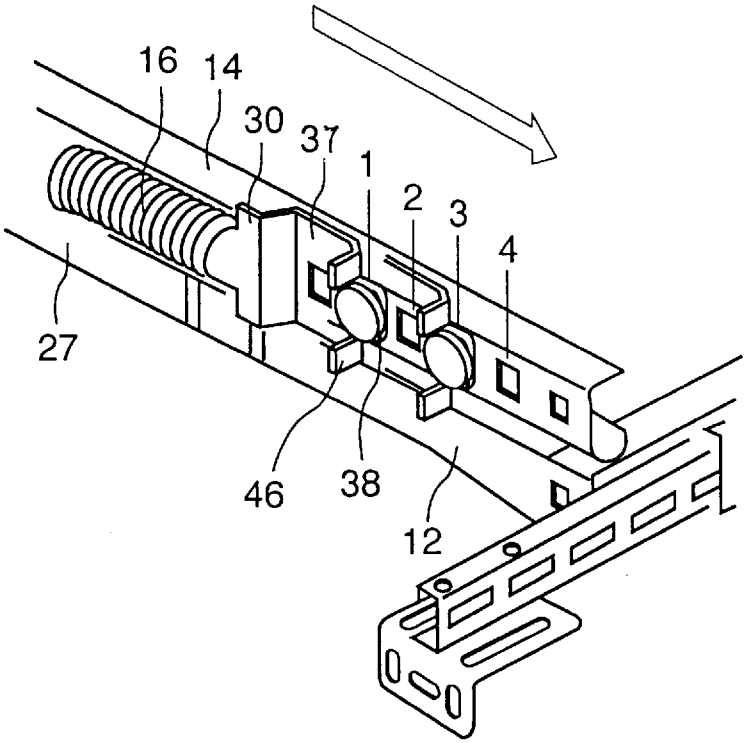
Figure 5D:
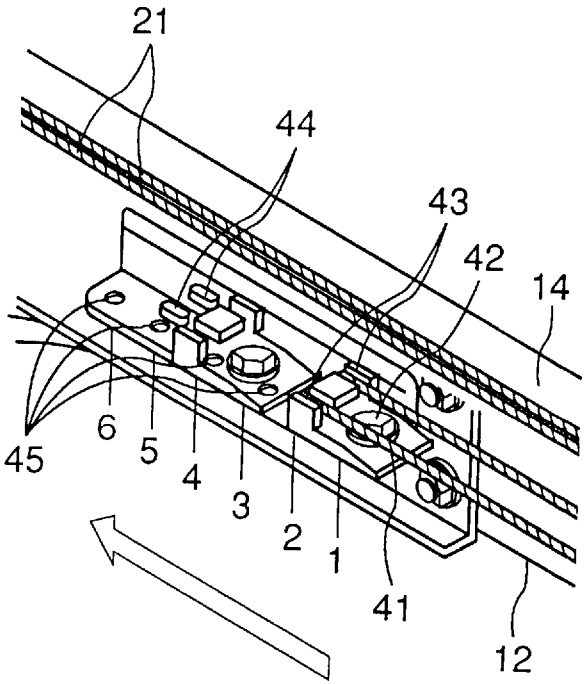
Figure 5C:
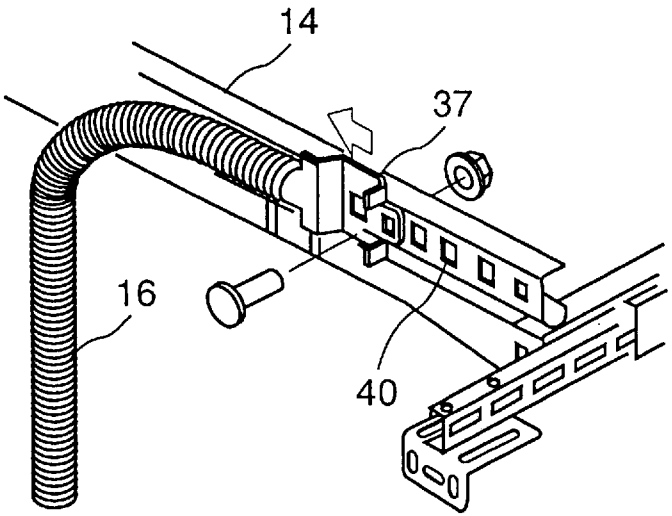

FIG. 5*d* illustrates how the doorway-side end of each parallel cable 21 is fastened at the edge of the door. The thicker ends 44 of the cables are accommodated like Bowden cables in suspensions 43 and held in place by the forces exerted on their associated pairs 25 of rollers by the spring modules. Suspensions 43 are mounted on a rocker 41 that pivots around an axis 42. Rocker 41 tilts to compensate for differences in length between the two cables 21 and to accordingly distribute the load. To facilitate compensation, the suspensions 43 on each side of axis 42 are farther from pair 25 of rollers than is the axis itself. To allow distance adjustment of this attachment, rocker 41 can be inserted into any desired opening in a series 45 extending along horizontal section 14, and the particular spring forces and cable lengths can be re-adjusted as the mechanisms age.

Figure 5F:
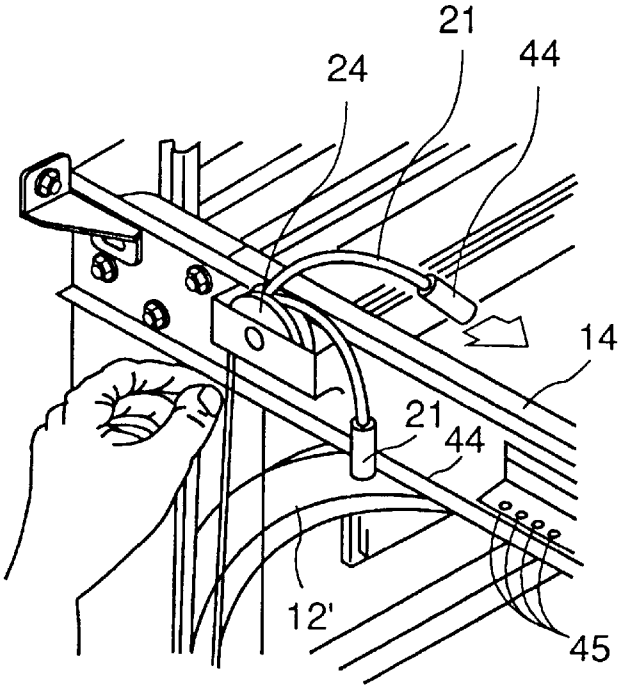
Figure 5E:
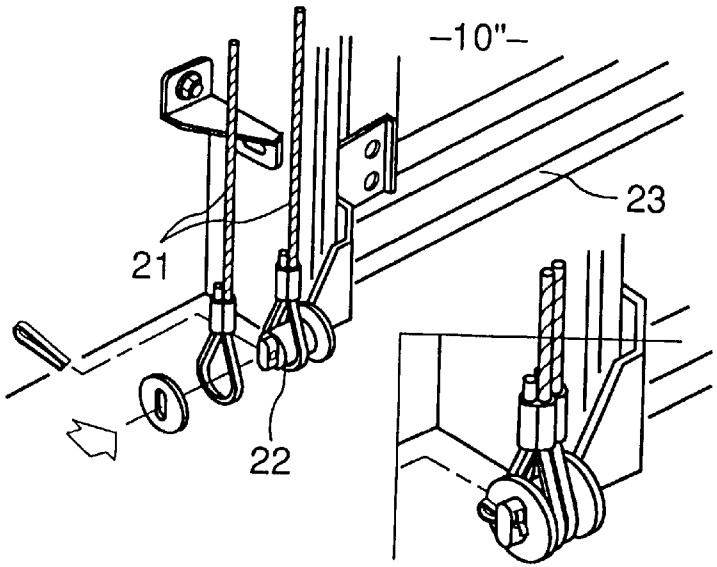

FIGS. 5*e* and 5*f* show how the other, looped, end of cable 21 is secured to a point 22 at the lower edge 23 of the panel 10" that is lowermost when the door is closed and how direction-reversing roller 24 is positioned and operates in the vicinity of horizontal section 14 and of downward-sloping section 14' near the building.

LIST OF PARTS

10. panel
10'. panel that is uppermost when the door is closed
10". panel that is lowermost when the door is closed
11. roller
12. first set of tracks, horizontal section
12'. first set of tracks, curved section
12". first set of tracks, vertical section
13. upper edge of panel 10'
14. second set of tracks, horizontal section
14'. second set of tracks, downward-sloping section
14". second set of tracks, bent-down section
15. weight-compensation mechanism
16. helical tension spring mechanism, spring module
17. inner spring
18. outer spring
19. overthrust coils
20. coil
21. cable
22. point of attachment
23. lower edge of panel 10"
24. direction-reversing roller
25. pair of deflection rollers
26. fixed cable end
27. side of horizontal section 14
28. building-end spring-module attachment
29. axis of spring
30. connector
31. spring-securing structure
31' spring-securing structure
31". spring-securing structure
32. narrower securing section
33. wider securing section
34. barbed projections
35. roller holder
36. counterbearing
37. deflection-roller anchoring structure
38. longer flange
39. shorter flange
40. series of punched-out holes
41. rocker
42. rocker axis
43. suspension
44. thicker cable end
45. series of openings
46. suspension clip
47. edge
48. depression
Di. inside coil diameter
Da. outside coil diameter

What is claimed is:

1. An articulated overhead door comprising: a plurality of panels linked together in series in a direction of motion;

rollers traveling in two sets of lateral tracks at each end of said panels for guiding said panels; a first set of said tracks having a substantially first vertical section merging into a curved section, said curved section being connected to a first horizontal section; a second set of said tracks having a second horizontal section merging in a downward-sloping section, said downward-sloping section being connected to a second vertical section having a location nearest the door, said second horizontal section being located above and parallel to said first horizontal section, all panels below an uppermost panel when the door is closed being guided by rollers traveling in said first set of tracks, said uppermost panel being guided by rollers traveling in said second set of tracks; door balancing means comprising helical tension springs with deflection rollers and cables, each of said springs having one end secured at a location spaced from the door, each spring having another end extending into an area of the door and secured to one of said deflection rollers, said cables being grouped in pairs, one of said pairs being adjacent each track, each of said cables being fixed at one common end and wrapped around one of said deflection rollers and extending to a point at one end of a bottom edge of a lowermost panel when the door is closed; modules combining said springs; at least a plurality of said modules comprising two coaxial helical springs with an outer coaxial spring and an inner coaxial spring, said coaxial springs having coils wound in opposite directions and being connected together at both ends and being simultaneously subjected to loads; each of said deflection rollers accommodating one of said cables, said deflection rollers being grouped in pairs, said cables having loads equally distributed by at least one of said modules; and cable-tension compensating means fastened to said common end.

2. A articulated overhead door as defined in claim 1, wherein said one end of said springs secured at a location spaced from the door has a variable position along an axis of said springs and along said second horizontal section by a series of openings extending along a track; deflection-roller anchoring means insertable into any one of said series of openings; flanges on said deflection-roller anchoring means and extending away from each other and away from said modules.

3. An articulated overhead door comprising: a plurality of panels linked together in series in a direction of motion; rollers traveling in two sets of lateral tracks at each end of said panels for guiding said panels; a first set of said tracks having a substantially first vertical section merging into a curved section, said curved section being connected to a first horizontal section; a second set of said tracks having a second horizontal section merging in a downward-sloping section, said downward-sloping section being connected to a second vertical section having a location nearest the door, said second horizontal section being located above and parallel to said first horizontal section, all panels below an uppermost panel when the door is closed being guided by rollers traveling in said first set of tracks, said uppermost panel being guided by rollers traveling in said second set of tracks; door balancing means comprising helical tension springs with deflection rollers and cables, each of said springs having one end secured at a location spaced from the door, each spring having another end extending into an area of the door and secured to one of said deflection rollers, said cables being grouped in pairs, one of said pairs being adjacent each track, each of said cables being fixed at one common end and wrapped around one of said deflection rollers and extending to a point at one end of a bottom edge of a lowermost panel when the door is closed; modules combining said springs; at least a plurality of said modules comprising two coaxial helical springs with an outer coaxial spring and an inner coaxial spring, said coaxial springs having coils wound in opposite directions and being connected together at both ends and being simultaneously subjected to loads; said two coaxial helical springs comprising an outer coaxial spring and an inner coaxial spring, said inner coaxial spring having an outside coil diameter that is shorter than the inside coil diameter of said outer coaxial spring, one of said coaxial springs having right-handed coils and the other one of said coaxial springs having left-handed coils intersecting said right-handed coils; common spring-securing means, said coils of said coaxial helical springs terminating in at least one common end of said spring-securing means; said spring-securing means comprising a first spring-securing section adjacent said coaxial helical springs and securing said inner coaxial spring, a second spring-securing section wider than said first section and securing said outer coaxial spring, said first and second spring-securing sections having edges with barbed projections for preventing said coils from being pulled off from over said sections, and a common connector for integrating an equal number of spring-securing means and said modules; said second spring-securing section comprising a holder for holding said deflection rollers; means for anchoring said deflection rollers to said first horizontal section associated with said deflection rollers; each of said deflection rollers accommodating one of said cables, said deflection rollers being grouped in pairs, said cables having loads equally distributed by at least one of said modules; and cable-tension compensating means fastened to said common end; said cable-tension compensating means comprising a rocker facing a pair of said deflection rollers and pivoting about a fixed axis with means in form of a Bowden-cable suspension on each side of said axis for suspending a thicker end of the cable; said fixed end having a variable position along said second horizontal section by a series of openings; one end of said springs secured at a location spaced from the door having a variable position along an axis of said springs and along said second horizontal section by a series of openings extending along a track; deflection-roller anchoring means insertable into any one of said series of openings; flanges on said deflection roller anchoring means and extending away from each other and away from said modules; one of said flanges being longer than another flange, and one of said flanges having a bore.

* * * * *